US006027686A

United States Patent [19]

Takahashi et al.

[11] Patent Number: 6,027,686

[45] Date of Patent: Feb. 22, 2000

[54] METHOD OF MANUFACTURING SINTERED COMPACT

[75] Inventors: Shoji Takahashi; Syozo Shimizu; Kenichi Shimodaira, all of Nagano-ken, Japan

[73] Assignee: Injex Corporation, Nagano-ken, Japan

[21] Appl. No.: 09/259,471

[22] Filed: Feb. 26, 1999

Related U.S. Application Data

[62] Division of application No. 08/881,916, Jun. 25, 1997, Pat. No. 5,911,102.

[30] Foreign Application Priority Data

Jun. 25, 1996 [JP] Japan ..... 8-164994
Jun. 25, 1996 [JP] Japan ..... 8-164996

[51] Int. Cl.[7] ..... B22F 3/12

[52] U.S. Cl. ..... 419/38; 419/2

[58] Field of Search ..... 419/2, 38

[56] References Cited

U.S. PATENT DOCUMENTS 4,992,233 2/1991 Swaroop ..... 419/2
5,053,361 10/1991 Herron et al. ..... 501/94
5,064,609 11/1991 Harada et al. ..... 419/58
5,376,601 12/1994 Okawa et al. ..... 501/98

FOREIGN PATENT DOCUMENTS 6-330105 11/1994 Japan .

*Primary Examiner*—Daniel J. Jenkins
*Attorney, Agent, or Firm*—Hill & Simpson

[57] ABSTRACT

In a method of manufacturing a sintered compact, a green body formed of titanium or titanium alloy powder is sintered in a furnace to produce a sintered compact. In this case, the green body is sintered under the condition that it is placed on a setter within a container formed of carbon materials. The setter is constructed from a base member and a plate-like green body contact portion joint onto the base material. The green body contact portion is formed of oxides of metals whose standard free energy of oxide formation is higher than that of the titanium or titanium alloy of the green body. The setter which has been already used is reused after the surfaces of the green body contact portion is ground or polished, so that a new green body is placed on the setter and then it is sintered again. In this way, increase of oxide in the obtained titanium and titanium alloy powder during sintering is restrained, thereby enabling to produce a high-quality sintered compact having a high dimensional accuracy easily with a low cost.

12 Claims, 2 Drawing Sheets

METHOD OF MANUFACTURING SINTERED COMPACT

This Application is a Divisional of U.S. patent application Ser. No. 08/881,916 filed Jun. 25, 1997 now U.S. Pat. No. 5,911,102.

BACKGROUND OF THE INVENTION

1. Field of the Invention

The present invention relates to a method of manufacturing a sintered compact by sintering a green body, in particular an injection-molded green body, composed of titanium or titanium alloy powder.

2. Description of the Prior Art

Titanium and titanium alloys are metallic materials that are lightweight, possess high strength, exhibit excellent corrosion resistance, and have other advantages. A drawback of these materials, however, is that they have poor workability, so that they can only be used in a limited number of fields and products.

Such titanium and titanium alloys are generally cast, forged, machined, and otherwise processed to be made into finished products, but the fabrication processes are complicated and the manufacturing costs are high because laser treatments must be performed or the materials must be machined using special tools. In particular, processing for obtaining complicated and intricate shapes requires complex fabrication processes and sophisticated techniques, thereby resulting in considerably higher manufacturing costs.

In order to solve such problems, a method has been proposed for forming (compacting) titanium or titanium alloy powders to a prescribed shape and then sintering the resulting green compact in a sintering furnace to manufacture titanium or titanium alloy sintered compacts (Japanese Laid-Open Patent Application No. 6-330105).

In this method, the green compact composed of a titanium or titanium alloy powder is placed on a supporting plate (setter), and such a green compact is sintered under the condition that the green compact is placed within a case which is formed of a metal such as molybdenum or tungsten, or a ceramic such as alumina. The supporting plate is formed of alumina or another material that remains stable at high temperatures.

However, the method described above has the following drawbacks which are resulted from use of the aforementioned materials for the supporting plate and the case.

First, the supporting plate formed of alumina reacts with the titanium or titanium alloy of the green compact during sintering, thus leading to increasing the oxygen content of the resulting sintered compact. As a result, there are drawbacks that the sintered compact is brittle and its strength is lowered.

Second, the supporting plate that has already been used can be reused in the subsequent sintering step, but if the reaction product from the previous sintering step has deposited on the surface of the supporting plate, there is a drawback that this reaction product forms a partial bond with the sintered compact, which resulting in adverse affects to the surface properties of the sintered compact or lowering the dimensional accuracy (stability for shape and dimension) of the sintered compact as a result of variations in the coefficient of contraction during sintering.

A particular advantage is that a sintered compact having a complex and intricate shape can be manufactured with high dimensional accuracy when the green body is manufactured by an injection molding of a metal powder, but this process is still seriously flawed in that this advantage cannot be fully demonstrated due to the existence of the aforementioned drawbacks.

Using a fresh supporting plate for each sintering cycle can be adopted in order to resolve these problems, but this approach involves a problem that it entails higher manufacturing costs.

Further, there is another problem in that cases formed of metals or ceramics are difficult to fabricate or machine. In particular, metal materials such as titanium, molybdenum, and tungsten are scarce and expensive, and cases formed of these materials must be often replaced because they lack durability and can be used only a few times.

In addition, sintering is sometimes performed by placing getters composed of titanium or the like into the case together with green bodies. In connection with this, there is a problem that since the getters used must have a weight that reaches or exceeds 50% of the weight of the green bodies, expensive getters are consumed in large amounts. Further, productivity is low because the packing of the getters is time-consuming and only a narrow storage space is available for the green bodies.

As stated in the above, although it is thus possible to manufacture titanium and titanium alloy sintered products, the manufacturing equipment, peripheral equipment, and other types of equipment are extremely expensive, so that a radical solution of the problems mentioned above has yet to be found.

SUMMARY OF THE INVENTION

In view of the foregoing, the object of the present invention is to provide a method of manufacturing a sintered compact by which a high quality titanium or titanium alloy sintered compact can be manufactured easily with a low cost.

Another object of the present invention is to provide a method of manufacturing a sintered compact by which a titanium or titanium alloy sintered compact having a high dimensional accuracy can be manufactured easily with a low cost.

In order to achieve these objects, the present invention is directed to a method of manufacturing a sintered compact by sintering at least one green body mainly composed titanium or titanium alloy powder under the condition that the green body is placed on a setter, wherein the setter has a green body contact portion which is adapted to contact with the green body placed thereon, and the green body contact portion is formed of an inactive material which does not react with the green body when sintered; and the setter is used by grinding or polishing a surface of the green body contact portion.

In the above method, it is preferred that the inactive material is mainly composed of oxide of metals whose standard free energy of oxide formation is higher than that of the titanium or titanium alloy of the green body.

The surface of the green body contact portion of the setter that has already been used in a sintering cycle is covered with a reactive product which has been reacted with components in the green body. Therefore, when the setter is used again for the next cycle of sintering, the deposited components are likely to be attached to a newly placed green body. However, such deposited components can be removed by grinding or polishing the surface of the green body contact portion before sintering. As a result, the characteristics of the obtained sintered compact becomes extremely excellent and shrinkage of the green body during sintering is kept constant, thereby improving dimensional accuracy of the sintered compact.

Further, the present invention is also directed to a method of manufacturing a sintered compact, in which sintered compact is manufactured by sintering at least one green body mainly composed titanium or titanium alloy powder under the condition that the green body is placed on a setter and such a manufacturing step is carried out more that two times, wherein the setter has a green body contact portion which is adapted to contact with the green body placed thereon, and the green body contact portion is formed of at least one oxide of elements selected from the group consisting of magnesium, calcium, zirconium and yttrium; and the setter which has already been used for the previous sintering is reused after grinding or polishing the surface of the green body contact portion.

The materials mentioned above are particularly effective for improving surface condition of the sintered compact, thereby lowering dimensional errors.

In this case, it is preferred that the grinding or polishing of the green body contact portion is performed each time upon sintering be carried out. In this way, it becomes possible to obtain a high-quality sintered compact with no deposition in every times.

It is also preferred that an amount of removal by the grinding or polishing is 20 to 500 $\mu$m in its mean thickness. In this way, the depositions which have been attached to the sintered compact during sintering can be removed sufficiently to an necessary extent, thereby increasing the reusable times of the setter.

Further, it is also preferred that the green body is sintered under the condition that the green body is accommodated within a container formed of carbon materials. Such an accommodation of the green body in the container contributes to a reduction of the oxygen and carbon in the sintered compact, thus enabling to maintain the mechanical strength of the sintered compact higher. Further, since the carbon materials have excellent heat conductivity, the green body can be heated rapidly and uniformly to obtain a sintered compact.

Furthermore, it is also preferred that the sintering is carried out under the condition that a getter is put within the container. In this way, it is possible to prevent oxygen (O) or carbon (C) from being deposited to the green body during sintering and then entering inside thereof, thereby enabling to maintain the mechanical strength of the sintered compact at a high level.

Moreover, it is also preferred that the container is constructed from a casing having an opening and a lid for closing the opening of the casing, in which when the opening is closed by the lid, the container is kept in a sealed condition or in a state that passage of air is considerably restrained. By constructing the container in this way, the sealing ability of the container is improved, which contributes to a reduction of oxygen or carbon in the sintered compact. Further, the green body can be easily put within the container, and the sintered compact can be easily taken out from the container.

In this case, it is preferred that the sintering is carried out under the condition that a getter is disposed in the vicinity of the opening of the container. Further, an amount of the getter to be packed is preferably set to 5 to 48 w % of the total weight of the green body. This enables the getter to exhibit its function effectively. Further, the getter is expensive material, but the amount of the getter to be used can be reduced by this arrangement, thus leading to a cost down of the sintered products.

Further, it is preferred that the setter is constructed from the green body contact portions and a base member of carbon materials which is joined to the green body contact portion. By constructing the setter in this way, heat conductivity to the green body at a sintering is improved, which contributes to further improvement in the quality of the sintered products.

Further, it is also preferred that a sintering atmosphere for the green body is a vacuum less than $1\times10^{-2}$ Torr or an inert gas atmosphere. This enables to carry out the sintering rapidly and effectively.

Further, it is also preferred that the green body is manufactured by a metallic powder injection molding method. Since the metallic powder injection molding method can produce a sintered compact having a complex and intricate shape with a high dimensional accuracy. Therefore, this method is particularly preferred, since the effects of the present invention are well exhibited when this method is employed.

The present invention is also directed to a method of manufacturing a sintered compact in which a sintered compact is manufactured by sintering at least one green body mainly composed titanium or titanium alloy powder, wherein the green body is sintered under the condition that the green body is accommodated within a container formed of carbon materials.

Since the carbon materials have excellent heat conductivity, use of such carbon materials enables to maintain temperature constant during sintering, which is effective in obtaining a high-quality sintered compact. Further, since the carbon materials can be easily processed or machined, it is possible to manufacture the container easily with a low cost.

In this case, it is preferred that the container is constructed from a casing having an opening and a lid for closing the opening of the casing, in which when the opening is closed by the lid, the container is kept in a sealed position or in a state that passage of air is considerably restrained. By constructing the container in this way, the sealing ability of the container is improved, which contributes to a reduction of oxygen or carbon in the sintered compact. Further, the green body can be easily put within the container, and the sintered compact can be easily taken out from the container.

It is also preferred that the sintering is carried out under the condition that a getter is disposed in the vicinity of the opening of the container. In this case, an amount of the getter to be packed is preferably set to 5 to 48 w % of the total weight of the green body. This enables the getter to exhibit its function effectively. Further, the getter is expensive material, but the amount of the getter to be used can be reduced by this arrangement, thus leading to a cost down of the sintered products.

Further, it is also preferred that a setter having a green body contact portion which is formed of an inactive material which does not react with the green body when sintered is provided in the container, in which sintering is carried out under the condition that the green body is placed on the green body contact portion of the setter. As for the inactive material, it is preferably selected from the group consisting of magnesium, calcium, zirconium, and yttrium. In this way, it is possible to prevent the green body from being reacted with the setter which supports the green body thereon during the sintering, thereby enabling to obtain a sintered compact having excellent surface characteristics and a high quality and high dimensional accuracy.

Furthermore, it is also preferred that a base member formed of carbon materials is joined to the green body contact portion. By constructing in this way, heat conductivity to the green body at a sintering is improved, which contributes to further improvement in the quality of the sintered products.

Moreover, it is also preferred that the container are formed of graphite or other carbon material containing major amount of graphite. Among carbon materials, graphite is particularly preferred since it contains less impurities and its price is low.

Preferably, the sintering is carried out in an atmosphere which is a vacuum less than $1\times10^{-2}$ Torr or an inert gas atmosphere. This enables to carry out the sintering rapidly and effectively.

Further, it is preferred that the green body is manufactured by a metallic powder injection molding method. Since the metallic powder injection molding method can produce a sintered compact having a complex and intricate shape with a high dimensional accuracy. Therefore, this method is particularly preferred, since the effects of the present invention are well exhibited when this method is employed.

Other aspect of the present invention is directed to a method of manufacturing a sintered compact in which a sintered compact is manufactured by sintering at least one green body mainly composed titanium or titanium alloy powder, wherein sintering is carried out under the condition that the green body is accommodated with in a container formed of carbon materials, and then the container is placed within a sintering furnace having walls formed of carbon materials.

In this case, it is preferred that the sintering is carried out under the condition that a getter in an amount of 5 to 48 w % of the total weight of the green body is put in the container.

According to this method, it is possible to prevent oxygen (O) or carbon (C) or the like from being entered into the green body effectively with a small amount of a getter, thereby enabling to obtain a high-quality and high-strength sintered compact.

Other objects, functions and advantages of the present invention will be apparent from the following description of the preferred embodiments taken in conjunction with the accompanying drawings.

DETAILED DESCRIPTION OF THE PREFERRED EMBODIMENTS

Figure 1:
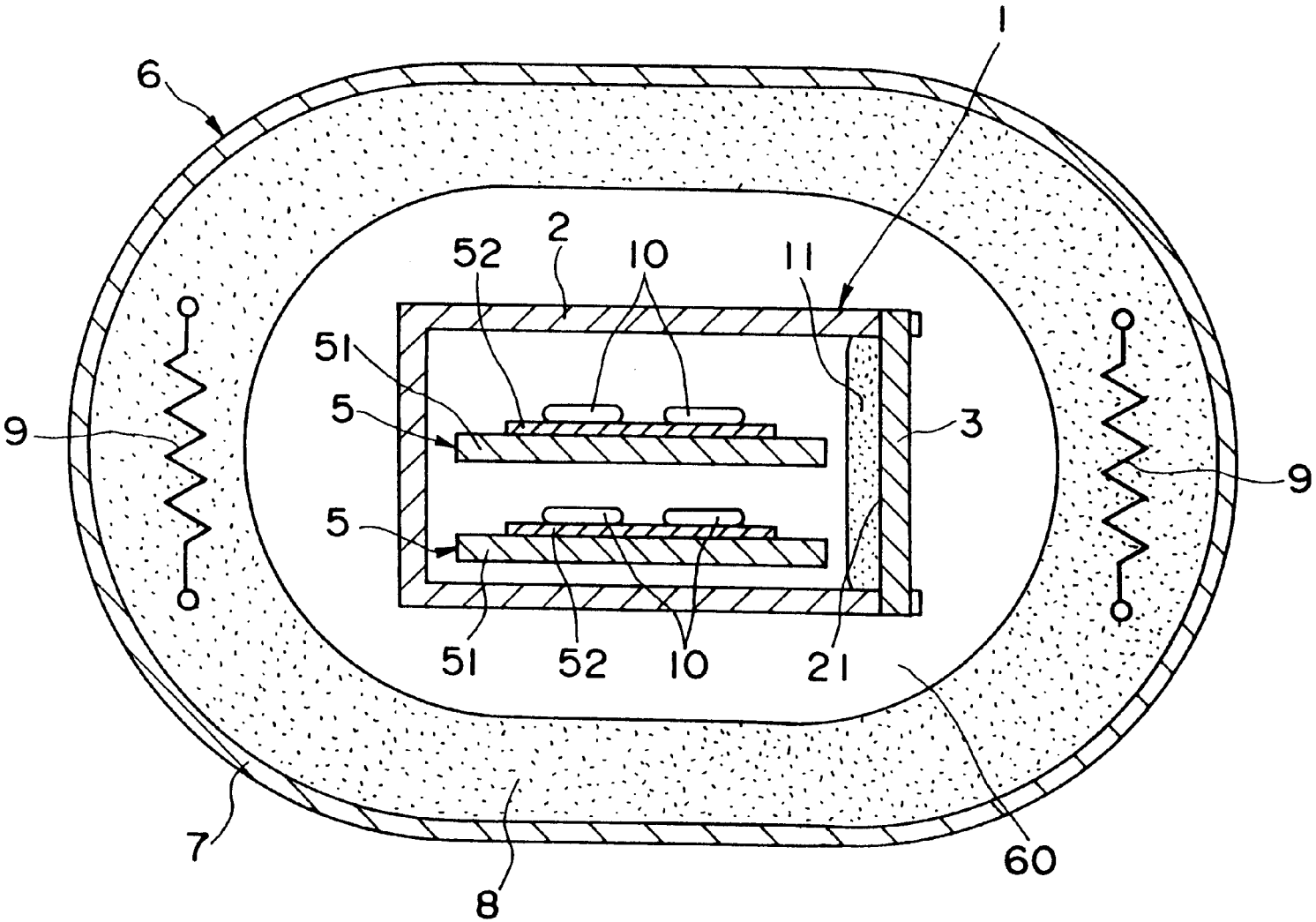
FIG. 1 is a cross sectional view which shows a structure of the sintering furnace used for the method of manufacturing a sintered compact according to the present invention.

A method for manufacturing a sintered compact according to the present invention will now be described in detail on the basis of preferred embodiments and examples with reference to the accompanying drawings.

(1) Production of Green Body

A green body used for sintering may be formed by one of the following methods: (A) metal powder injection molding method (MIM: Metal Injection Molding) and (B) green compact forming method. The metal injection molding is advantageous in that it allows sintered compacts having complex and intricate shapes to be manufactured with high dimensional accuracy. This method is therefore particularly preferred to the present invention because it yields a remarkable effect when the present invention is applied thereto. Each of these methods will now be described below in this order.

(A-1) A binder (organic binder) and a metal powder consisting of titanium or a titanium alloy are prepared, and these ingredients are compounded in a compounder to obtain a compound.

Examples of metals that, together with titanium, make up the titanium alloy include at least one or more of the following metals: iron, chromium, palladium, cobalt, zirconium, aluminum, vanadium, molybdenum, tin, silver, and nickel. It is preferable for the total content of metals other than titanium in this case to be 60 wt % or less, and particularly 50 wt % or less.

The metal powder may also contain traces (unavoidable) of oxygen, carbon, nitrogen, hydrogen, and other elements. In this case, it is preferable for the content of these elements to be 0.3 wt % or less for oxygen, 0.3 wt % or less for carbon, 0.5 wt % or less for nitrogen, and 1.0 wt % or less for hydrogen. It is also preferable for the combined content of oxygen, carbon, nitrogen, and hydrogen to be 2.3 wt % or less. If these elements are contained in excessive amounts, strength decreases due to the embrittlement of the resulting sintered compact.

The mean grain diameter of the metal powder is not subject to any particular limitations. However, in normal cases, the diameter is preferably set to about 2 to 300 $\mu$m, and more preferably set to 5 to 50 $\mu$m.

Examples of binders include polyethylene, polypropylene, ethylene-vinyl acetate copolymers, and other polyolefins; polymethyl methacrylate, polybutyl methacrylate, and other acrylic resins; polystyrene and other styrene-based resins; and polyvinyl chloride, polyamides, polyesters, polyethers, polyvinyl alcohol, copolymers thereof, and various other resins; as well as various waxes, paraffin, higher fatty acids (for example, stearic acid), higher alcohols, higher fatty acid esters, higher fatty acid amides, phthalic acid esters, adipic acid esters, trimellitic acid esters, and sebacic acid esters. These binders can be used individually or as mixtures of two or more components described above.

It is preferable for the total amount in which such binders are added to be about 4 to 25 wt %, and more preferably about 8 to 20 wt %. When the amount is less than 4 wt %, fluidity is low during molding, precluding or impairing injection molding or resulting in a green body with a nonuniform composition. On the other hand, if the amount is greater than 25 wt %, the coefficient of contraction during the calcining of the green body obtained by injection molding is increased, tending to lower the dimensional accuracy and to increase the porosity or carbon content of the sintered compact.

Plasticizers, lubricants, antioxidants, debinding accelerators, surfactants, and various other additives can also be added as needed in addition to the aforementioned metal powders and binders during compounding.

The compounding conditions vary with the grain diameter of the metal powder used, the composition and the amount of the binder, and other parameters. However, as for one example thereof, a compounding temperature can be in the range from room temperature to about 160° C., and a compounding time can be about 20 to 210 min.

(A-2) Using the compound obtained in the above-described step (A-1) (or pellets obtained by the granulation of this compound), injection molding is performed by an injection molding machine to obtain a green body (molded body) that has the desired shape. In this case, a green body having a complex and intricate shape can be easily manufactured by the selection of an appropriate mold.

The injection molding conditions vary with the grain diameter of the metal powder used, the composition and amount of the binder, and other parameters. These conditions may, for example, include a preferred material temperature (mold temperature) of about 80 to 200° C., and a preferred injection pressure of about 20 to 150 kgf/cm$^2$.

(A-3) A debinding treatment (binder removal treatment) is carried out on the green body obtained in the above-described step (A-2). This debinding treatment is accomplished by performing a heat treatment in a nonoxidizing atmosphere such as a vacuum, a reduced-pressure atmosphere (for example, $1\times10^{-1}$ to $1\times10^{-6}$ Torr), or an inert gas such as nitrogen gas or argon gas.

In this case, the heat treatment conditions are preferably a temperature of about 50 to 700° C. and a duration of about 3 to 72 hours, and more preferably a temperature of about 60 to 550° C. and a duration of about 6 to 36 hours.

The debinding treatment may be accomplished by eluting prescribed components from the binder or additives with the aid of prescribed solvents (liquids, gases).

(B-1) With the green compact forming method, a metal powder composed of the aforementioned titanium or titanium alloy is uniformly mixed with additives such as molding assistants, and the resulting mixture is packed into the mold of a pressure molding machine and then subjected to pressure molding. A green body (green compact) having the desired shape is thus obtained.

As for examples of the molding assistants, various waxes, paraffins, and higher fatty acids (for example, stearic acid) and the like can be mentioned. The amount in which such molding assistants are added may, for example, be about 0.5 to 5 wt %.

In addition, the preferred temperature (mold temperature) of the material during the pressure-molding is between room temperature and about 80° C., and the preferred pressure is about 20 to 120 kgf/cm$^2$.

(B-2) The same debinding treatment as that described above can be performed as needed.

(2) Sintering of Green Body

The green body thus obtained is calcined and sintered in a sintering furnace to obtain a metallic sintered compact.

Figure 2:
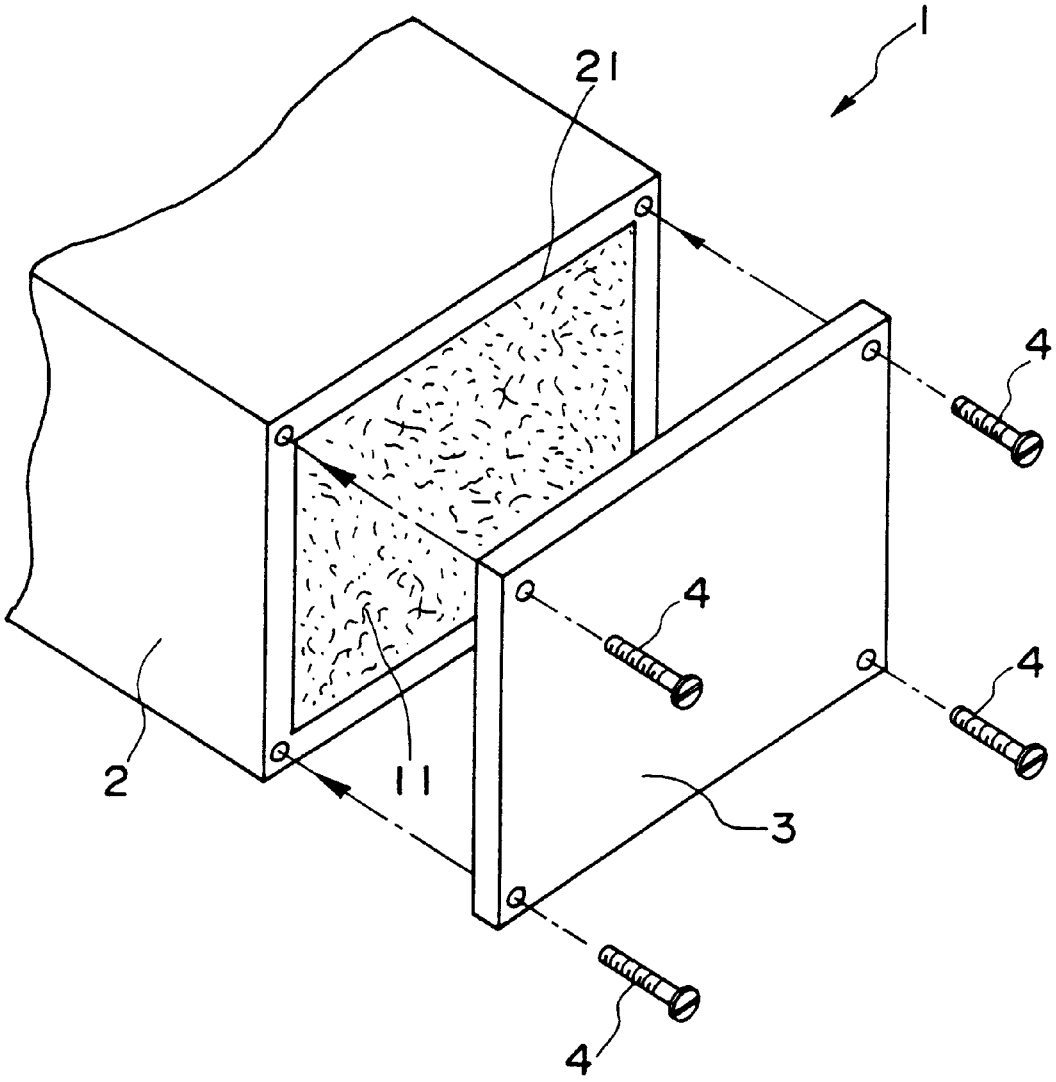
FIG. 2 is a perspective view which shows a structure of a container which accommodates green bodies.

FIG. 1 is a cross section schematically depicting the structure of the sintering furnace used in the method of manufacturing a sintered compact according to the present invention, and FIG. 2 is an oblique view depicting the structure of the container for accommodating green bodies.

Green bodies 10 are placed inside a container 1 which is, for example, formed of a heat-resistant material such as a carbon material. Then, the container 1 is inserted into a sintering furnace 6, and then the sintering furnace 6 is operated to perform sintering.

The container 1 comprises a casing body 2 having an opening 21 at one end, and a lid 3 that covers the opening 21. As shown in FIG. 2, the lid 3 is fixed to the body 2 by screws 4 at the corner portions thereof, thereby covering the opening 21. When the lid 3 covers the opening 21, the container 1 is in a sealed state (or a semi-sealed state) or in a state where passage of gases through the joints between the body 2 and the lid 3 is restrained.

A getter 11, which will be described below, is disposed near the opening 21 of the container 1, that is, in the vicinity of the back surface of the lid 3, in such a way that virtually the entire area of the opening 21 is covered. Positioning the getter 11 in this location, that is, in a location where gases are very likely to pass into or out of the container 1, allows the getter 11, which is described below, to perform its functions more efficiently, which contributes to a reduction in the amount in which the getter 11 is packed.

Such a container 1, that is, the body 2 and the lid 3, can be formed of a heat-resistant material such as stainless steel, titanium, molybdenum, tungsten, an alloy containing these, or any other metallic materials; alumina, zirconia, magnesia, calcia, yttria, or any other ceramics; or various carbon material. In these materials, carbon materials are particularly preferred due to the reasons described below.

Examples of carbon materials for the container 1 include "black lead" (natural or artificial), vitreous carbon, graphite, and aggregated carbon fibers and carbon powders. In these carbon materials, graphite and graphite-based materials are particularly preferable due to their high strength, low impurity content, and low cost.

In this connection, aggregated carbon fibers are particularly preferable for the screw members 4, since they require to have high-strength.

Because graphite and other carbon materials have a high thermal conductivity, constructing the container 1 with such materials allows the green bodies 10 placed inside the container 1 to be heated and sintered rapidly and uniformly at the start of sintering. In addition, graphite and other carbon materials are inexpensive and amenable to processing, making it possible to manufacture the container 1 easily and at a low cost.

In particular, graphite and other carbon materials are advantageous when a container 1 having a complex shape is to be manufactured. For example, when grooves or steps (not shown) or other like which are used for supporting setters 5 are formed in the inner wall surfaces of the container 1, it is possible to form or produce them easily by means of cutting or the like.

In addition, since graphite and other carbon materials have high heat resistance, they are not likely to be deteriorated, deformed and damaged due to heat during sintering, thereby making it possible to repeatedly reuse a single container 1 and to achieve considerable durability. As a result, it is not necessary to replace the container 1 due to its deterioration. This means that it is not necessary to frequently replace the container 1. Further, the container is easy to handle. For these reasons, the use of graphite and other carbon materials contributes to a further reduction in its manufacturing costs.

In the container 1, the setters 5 for supporting the green bodies 10 are provided. Preferably, they are provided in a freely detachable manner. It is preferred that the setters 5 are constructed from a plate-shaped base 51 formed of a carbon material such as described above, and a plate-shaped (layered) green body contact portion 52 bonded to or placed on the top of this base 51. Green bodies 10 are sintered under the condition that they are placed on the green body contact portions 52.

The green body contact portions 52 should be formed of a material which is unreactive or poorly reactive with the green bodies 10 during sintering. Examples of such materials include materials whose main components are oxides of metals whose standard free energy of oxide formation is higher than that of the titanium or titanium alloy of the green bodies 10 within the range of sintering temperatures. Preferred examples thereof include at least one oxide of the metals selected from the group consisting of magnesium, calcium, zirconium, and yttrium, and particularly magnesia (MgO), calcia (CaO, $CaO_2$), zirconia ($ZrO_2$), and yttria ($Y2O_3$). Other components may also be added to the materials of the green body contact portions 52 as long as they do not initiate a reaction with the green bodies 10 during sintering.

By forming the green body contact portions 52 from such materials, it becomes possible to minimize reactions with the green bodies 10 during sintering. In particular, since the transfer of oxygen (O) into the green bodies 10 hardly occurs, it is possible to significantly reduce the oxygen concentration of the resulting sintered compacts, thereby enabling to prevent strength from being lowered by the embrittlement of the sintered compacts, and to improve dimensional accuracy (shape, dimensional stability).

In the preferred embodiment, each of the green body contact portions 52 is formed into a plate-like shape (layered structure), and its thickness, although not subject to any particular limitations, is commonly about 2 to 10 mm, and preferably about 3 to 5 mm. When the green body contact portion 52 is too thin, its strength decreases and thereby it is likely to be damaged. On the other hand, when the green body contact portion 52 is too thick, its heat loss increases. As a result, it becomes more difficult to obtain a uniform temperature distribution inside the furnace. Further, fewer green bodies can be accommodated, thus leading to increase in manufacturing costs.

The green body contact portions 52 are not limited to a plate-like shape (layered structure). The may be, for example, formed into bar-shaped structure (a plurality of lines), reticulated structure (intersecting lines), or a plurality of protrusions. In particular, these are preferred because of the reduced surface area of contact with the green bodies 10, which resulting in more uniform sintering.

The base 51 of the setter 5, in addition to functioning as a support member, also functions to enhance the strength of the green body contact portion 52. In this connection, it is preferable for the base 51 to be formed of a carbon material because this material is easy to machine, and thermal conductivity of the setter 5 is improved to enable sintering to be conducted uniformly.

The getter 11 is provided for adsorbing (trapping) oxygen, carbon, and other substances in advance in order to prevent them from depositing on or penetrating into the green bodies 10 during sintering. For example, the getter 11 is formed of titanium, titanium alloy, zirconium, zirconium alloy, or any other material described above. In addition, it is preferred that the getter 11 is formed from a porous body (sponge), cuttings, aggregated fibers (thin threads), aggregated granules or powders, or the like.

In the present invention, placing the getter 11 in such a location and adopting other measures make it possible to manufacture high-quality sintered compacts while packing the getter 11 into the container 1 in smaller amounts than in the past. Specifically, it is preferable for the amount in which the getter 11 is packed to be about 5 to 48%, and particularly about 10 to 40%, of the total weight of the green bodies 10. When the amount is less than 5%, the getter 11 cannot perform its functions fully, and there is the danger that the resulting sintered compact will be embrittled when the container 1 is sealed poorly. On the other hand, when the amount exceeds 48%, the manufacturing efficiency (productivity) of the sintered compacts decreases because the space occupied by the getter 11 inside the container 1 increases and in tune the space for accommodating the green bodies 10 is reduced to the extent.

Thus, reducing the amount in which the getter 11 is packed means that the consumption of the getter 11 is reduced. Therefore, in this way, it is possible to reduce the costs. Further, since the packing operation of the getter 11 becomes easier, better operability is achieved.

It is apparent that the amount in which the getter 11 is packed may be less than 5 wt % (including zero) of the total weight of the green bodies 10 when the container 1 is thoroughly sealed and in some other cases, although this figure varies with the conditions.

The sintering furnace 6 comprises an outer wall 7 made of a metal such as stainless steel, and an inner wall 8 that is bonded to the inside of the outer wall 7 and is preferably made of a carbon material. A space 60 capable of accommodating the container 1 is formed inside the inner wall 8. In addition, heaters 9 such as, for example, graphite heaters are provided in locations facing each other across the space 60 inside the inner wall 8.

Agglomerated carbon fibers (graphite fibers or the like) or carbon powders are preferable as the carbon material for the inner wall 8. As described above, using such a carbon material to construct the inner wall 8 yields an excellent thermal conductivity and makes it possible to easily manufacture and machine the inner wall 8 and to reduce its cost without causing any deterioration.

When the initial cycle of sintering is performed using such a sintering furnace 6, green bodies 10 are first placed in prescribed locations on the green body contact portions 52 of the setters 5 inside the container 1, the lid 3 is placed on the body 2 to cover the opening 21, the container 1 is introduced into the space 60 of the sintering furnace 6, and then the heaters 9 are operated to heat the interior of the sintering furnace 6 to a prescribed temperature.

The conditions adopted for such sintering are preferably a temperature of about 800 to 1450° C. and a time of about 2 to 30 hours, and more preferably a temperature of about 1000 to 1350° C. and a time of about 2.5 to 20 hours.

It is preferable in this case for the sintering atmosphere, that is, for the atmosphere inside the container 1, to be nonoxidizing, that is, a vacuum, a reduced-pressure atmosphere (preferably $1\times10^{-2}$ Torr, and more preferably $1\times10^{-2}$ to $1\times10^{-6}$ Torr), an inert gas such as nitrogen gas or argon gas, or a reducing atmosphere. In this regard, the sintering atmosphere may be changed during sintering.

Once the sintering is completed in such a manner, the container 1 is taken out from the sintering furnace 6, the lid 3 is taken off, and then the sintered compacts are taken out from the container 1.

It is preferable for the sintering furnace 6 and the container 1 to be reused. In this case it is preferred that the surfaces of the green body contact portions 52 of the setters 5 are ground or polished before the next cycle of sintering is performed. This procedure will now be described in detail.

The surfaces of the green body contact portions 52 of the setters 5 that have already been used in a sintering cycle are covered with a deposited titanium or titanium alloy powder that has separated from the green bodies 10 or with the product of a reaction between the green bodies 10 and the titanium or titanium alloy. This deposit, while present in a trace amount, still reacts and bonds with the deposit formed during the sintering of newly mounted green bodies when allowed to remain during the repeated use of the setters 5 (in the subsequent sintering cycles). As a result, the surface properties of the resulting sintered compacts sometimes deteriorate. In addition, since the portion bonded to the deposit on the respective sintered compact undergoes limited shrinkage during sintering, there arises a difference in shrinking rate between the bonded portion and other portion. This produces a nonuniform rate of shrinkage of the entire product, thus resulting in creating errors in the shape and size of the sintered compact and lowering its dimensional accuracy.

Therefore, in the present invention, the surfaces of the green body contact portions 52 of the setters 5 which are already used in a sintering cycle are ground (cut) or polished to remove the aforementioned deposit, and the next sintering cycle is conducted in this state. In this way, it is possible to prevent the aforementioned deposit formed during sintering from having an adverse effect such as that described above on the sintered compacts during the subsequent sintering cycle.

The methods used to perform grinding or polishing are not subject to any particular limitations. They can be accomplished using grinders (grinding tools), burnishers (polishing tools), or the like. Any combination of grinding and polishing can also be employed.

The amount of material removed from the surface of a green body contact portion 52 by such grinding or polishing, although not subject to any particular limitations, corresponds to a thickness (mean) that is usually about 0.005 to 0.5 mm, and preferably about 0.05 to 0.3 mm. When the thickness reduction is less than 0.005 mm, it is sometimes impossible to remove the deposit properly under certain sintering conditions or the like. On the other hand, when the reduction exceeds 0.5 mm, the green body contact portions 52 are consumed excessively and can be reused a fewer number of times.

It is preferable for the surfaces of the green body contact portions 52 to be ground or polished in this way every time a sintering cycle is performed, that is, every time the green bodies 10 are replaced. It is also possible for a setter 5 whose green body contact portion 52 has been ground or polished in advance to be replaced and reused every time sintering is carried out.

Although it is preferable for the surfaces of the green body contact uniformly 52 to be ground or polished uniformly (for the material to be removed uniformly), it is also possible, for example, to grind or polish only the portions that carry the green bodies 10 or to perform other types of partial treatment.

In addition, it is preferable for the ground or polished surfaces of the green body contact portions 52 to be flat, but the surface shape is not limited to this option alone and may also be curved, for example. It is also preferable for the grinding or polishing to be performed in such a way that the resulting surface is smooth (for example, to achieve a surface roughness Ra, as defined in JISB0601, of 50 $\mu$m or less).

It is preferable for the setters 5 to be removable from the container 1 because such grinding or polishing is easier to perform after the setters 5 have been taken out from the container 1.

The sintered compact manufactured by the above described steps has a high-quality; that is, it has high strength; contains little oxygen, carbon, or the like; has a uniform (constant) shape; and possesses high dimensional accuracy.

In addition, the porosity of the sintered compact is low, thereby contributing to improved strength and the like. For example, the porosity is preferably 10% or lower, more preferably about 1 to 5%, and most preferably about 1 to 3.5%.

The sintered compacts obtained in accordance with the present invention are not subject to any particular limitations in terms of possible applications. Examples of the possible applications include watch cases and bezels, golf club heads, materials for artificial joints and various other medical applications, implants, materials for orthodontic brackets and various other dental applications, and various other mechanical parts.

Hereinbelow, specific examples of the invention will be described.

EXAMPLE 1-0, EXAMPLE 2-0, EXAMPLE 3-0 and EXAMPLE 4-0

(The numerals following the hyphens indicate the number of polishing cycles performed on the surfaces of the setters; same below)

The following three ingredients were mixed: a metal powder with the composition shown in the attached Table 1, a binder containing 5 wt % acrylic resin and 5 wt % wax, and dibutyl phthalate (plasticizer) in an amount of 1 wt %. These ingredients were compounded in a compounder for 2 hours at 90° C.

The resulting compound was subsequently used to perform metal injection molding with the aid of an injection molding machine, yielding annular green bodies with an outer diameter of 30 mm, an inside diameter of 20 mm, and a thickness of 5 mm. The molding conditions during injection molding corresponded to a material temperature of 150° C. and an injection pressure of 50 kgf/cm$^2$.

The resulting green bodies were subsequently debinded for 2 hours in nitrogen gas atmosphere at 400° C.

The resulting green bodies in an amount of 10 kg were subsequently introduced together with a getter in an amount of 2 kg into a graphite container, and then sintered in a sintering furnace which is constructed from a carbon-fiber inner wall and carbon heaters as shown in FIG. 1, yielding sintered compacts.

The graphite container comprised a casing and a lid for covering an opening formed in this casing. A substantially sealed state could be maintained when the lid was closed, and the capacity was about 0.05 m$^3$. In addition, setters obtained by bonding graphite plates to green body contact layers (thickness: 5 mm) formed of the various materials shown in the attached Tables 2 and 3 were removably installed inside the graphite container. Then, a plurality of green bodies were placed on the green body contact layers (new products) of these setters, and then these green bodies were sintered.

A getter consisting of pure porous titanium was placed in such a way that the opening in the aforementioned casing was covered.

In addition, sintering was carried out for 3 hours at 1200° C., and the sintering atmosphere was a vacuum of $5\times10^{-3}$ Torr.

EXAMPLES 1-1 to 1-4, EXAMPLES 2-1 to 2-3, EXAMPLES 3-1 to 3-3, and EXAMPLES 4-1 to 4-3

After the sintered compacts manufactured in accordance with each of the above-described examples were taken out, the surfaces of the green body contact layers (green body contact portions) of the setters were polished with a polisher and finished to obtain flat and smooth surfaces (surface roughness Ra, as defined in JIS B 0601, was 30 $\mu$m). The attached Tables 2 and 3 show the amounts (mean thickness reductions) in which the material was removed from the surfaces of the green body contact layers in this case.

Green bodies manufactured using these setters under the same conditions as above were sintered under the same conditions, yielding sintered compacts.

The manufacture of the green bodies, the surface polishing of the green body contact layers, and the sintering of the green bodies with the aid of the polished setters were then repeated under the same conditions as above, yielding sintered compacts in each case.

Comparative Examples 1, 2, 3, and 4

After Examples 1-4, 2-3, 3-3, and 4-3 had been performed, green bodies were again sintered and sintered compacts obtained under the same conditions but without the surface polishing of the green body contact layers.

Comparative Example 5

Sintered compacts were manufactured in the same manner as in Example 1-0 except that the green body contact layers were composed of alumina. Alumina is an oxide ($Al_2O_3$) of aluminum, which has a higher standard free energy of oxide formation than titanium.

The annular sintered compacts obtained in the above-described embodiments and comparative examples were measured for inside diameter dimensions and diameter distortion (equal to the difference between maximum and minimum inside diameters), and the oxygen content and porosity were also analyzed and measured. The results are shown in the attached Tables 2 and 3.

As can be seen in the attached Tables 2 and 3, the sintered compacts obtained in the embodiments have low diameter distortion, that is, high dimensional accuracy (dimensional stability), and exhibit low oxygen content and porosity. The low oxygen content and porosity enhance the strength of the sintered compacts.

In contrast with the above Examples, Comparative Examples 1 through 4 show considerable diameter distortion and an increased oxygen content because the surfaces of the green body contact layers were not polished. This result is attributed to the fact that the precipitated deposit remaining on the green body contact layers from the previous cycle of sintering reacts with the green bodies and forms partial bonding.

In addition, the diameter distortion and oxygen content are even higher in Comparative Example 5. This result is attributed to the reaction between the titanium in the green bodies and the oxygen atoms in the alumina of the green body contact layers.

EXAMPLE 5-0

Green bodies (wristwatch cases) were manufactured under the same conditions as in Example 1-0 described above. Each of the green bodies was formed into a disk-like shape having an outside diameter of 30 mm, with intricate and complex irregularities formed along the outside perimeters of the disk.

The green bodies were then sintered under the same conditions as in Example 1-0 or the like, except that the capacity of the graphite container was set to about 0.1 $m^3$, the total weight of the green bodies to 30 kg, and the packing amount of the getter to 8 kg. The attached Table 4 shows the material used for the green body contact layers in the setters, with the thickness being set to 5 mm.

EXAMPLES 5-1 THROUGH 5-4

After the sintered compacts manufactured in Example 5-0 above had been taken out, the surfaces of the green body contact layers of the setters were first ground with a grindstone, then polished with a polisher, and finally finished to obtain flat and smooth surfaces (surface roughness Ra=30 $\mu$m). The attached Table 4 shows the amount (mean thickness reduction) in which the material was removed from the surfaces of the green body contact layers in this case.

Green bodies manufactured under the same conditions as above were sintered using these setters under the same conditions, yielding sintered compacts.

The manufacture of the green bodies, the surface grinding and polishing of the green body contact layers, and the sintering of the green bodies using the ground and polished setters were then repeated under the same conditions as above, yielding sintered compacts.

Comparative Example 6

After Example 5-4 had been performed, green bodies were again sintered and sintered compacts obtained under the same conditions but without the surface grinding or polishing of the green body contact layers.

The sintered compacts (wristwatch cases) obtained in Examples 5-1 through 5-4 and Comparative Example 6 above were measured for inside diameter dimensions and diameter distortion (equal to the difference between maximum and minimum inside diameters), and the oxygen content and porosity were also analyzed and measured. The results are shown in the attached Table 4.

As can be seen in Table 4, the sintered compacts obtained in Examples 5-1 through 5-4 have low diameter distortion, that is, high dimensional accuracy (dimensional stability), and exhibit low oxygen content and porosity. The low oxygen content and porosity enhance the strength of the sintered compacts.

In contrast with these Examples, Comparative Example 6 shows considerable diameter distortion and an increased oxygen content because the surfaces of the green body contact layers were not polished. The reason for this is believed to be the same as in Comparative Examples 1 through 4 above.

Hereinafter, the specific examples of the invention will be described.

EXAMPLES 6 THROUGH 8

A metal powder with the composition shown in the attached Table 1 was uniformly mixed with 1 wt % stearic acid (molding assistant), and the resulting mixture was packed into the mold of a pressure molding machine and green-formed into plates with a length of 50 mm, a width of 10 mm, and a thickness of 5 mm. The molding was conducted at normal temperature and a molding pressure of 100 $kgf/cm^2$.

The resulting green bodies were subsequently introduced together with a getter into a graphite container and then sintered in a sintering furnace which is constructed from graphite heaters and carbon-fiber inner walls as shown in FIG. 1.

The graphite container comprised a casing and a lid. A substantially sealed state could be maintained when the lid was closed, and the capacity was about 0.05 $m^3$. In addition, setters obtained by bonding graphite plates to green body contact layers formed of zirconia ($ZrO_2$) were installed inside the graphite container, and a plurality of green bodies were placed on the setters and sintered.

A getter consisting of pure porous titanium was placed in such a way that the opening of the aforementioned casing was covered. The getter was packed into the container in three different amounts, which corresponded to Examples 6, 7, and 8.

In addition, sintering was performed for 3 hours at 1200° C., and the sintering atmosphere was a vacuum of $5\times10^{-3}$ Torr.

Lengthwise elongation, which is one of indices of mechanical strength, was measured for the resulting sintered compacts, and the carbon content, oxygen content, and porosity were also analyzed and measured.

The ease with which the container for accommodating green bodies could be manufactured was also studied. Ease of manufacture was evaluated in the following manner: a container was manufactured for a starting material, the time needed to complete the assembly of the container was measured, this time and the time needed for machining were collectively determined, and the results were evaluated in accordance with a four-point scale represented by the symbols ◎, ○, Δ, x in order of ease of manufacture.

The container was used repeatedly for sintering, and its service life (effective number of uses) was determined. The effective number of uses was determined based on the number of cycles to the point of time where any of the following defects were developed in the container: deformation, deterioration, damage, reduction in sealing properties, or the like.

The results thereof are shown in the attached Table 5.

Comparative Examples 7 Through 10

Sintered compacts were manufactured under the same conditions as in Examples 6 through 8, and the same measurements were performed, except that the container for accommodating the green bodies was made of titanium (Comparative Example 7), molybdenum (Comparative Example 8), or alumina (Comparative Example 9).

In addition, sintered compacts were manufactured in the same manner as in Examples 6 through 8 and the same measurements were performed, except that the container was not used and the green bodies were directly introduced into the sintering furnace and sintered (Comparative Example 10).

The results thereof are shown in the attached Table 5.

It can be seen in Table 5 that despite the fact that the getter was packed in a smaller amount in each of Examples 6 through 8, the resulting sintered compacts are on a par with or better than those obtained in Comparative Examples 7 through 10 in terms of quality; that is, they have high elongation (high strength), low carbon content, low oxygen content, and low porosity.

In addition, the graphite containers of Embodiments 6 through 8 are much easier to machine or manufacture than those in Comparative Examples 7 through 9 and have a considerable service life (effective number of uses), thereby making it possible to achieve a substantial cost reduction.

Furthermore, operability is better in Examples 6 through 8 than in Comparative Examples 7 through 10.

EXAMPLES 9 THROUGH 11

The following three ingredients were mixed: a metal powder with the composition shown in Table 1, a binder containing 5 wt % acrylic resin and 5 wt % wax, and dibutyl phthalate (plasticizer) in an amount of 1 wt %. These ingredients were compounded in a compounder for 2 hours at 90° C.

The resulting compound was subsequently used to perform metal injection molding with the aid of an injection molding machine, yielding green bodies (wristwatch cases). The molding conditions during injection molding corresponded to a material temperature of 150° C. and an injection pressure of 50 kgf/cm$^2$.

Each of the green bodies was formed into a disk-like shape having an outside diameter of 30 mm, with intricate and complex irregularities formed along the outside perimeters of the disk.

The resulting green bodies were subsequently debinded for 2 hours in a 400° C. nitrogen gas atmosphere.

The green bodies were sintered under the same conditions as in Examples 6 through 8, except that the capacity of the graphite container was set to about 0.1 m$^3$. The combinations of the total amount of the green bodies and the amount in which the getter was packed into the container were varied, yielding the results corresponding to Examples 9, 10, and 11.

Vickers hardness (HV), which is one of indices of the mechanical strength, was measured for the resulting sintered compacts, and the carbon content, oxygen content, and porosity were also analyzed and measured.

In addition, the ease of manufacture of the container and its service life (effective number of uses) were also determined by the same method as above.

The results thereof are shown in the attached Table 6.

Comparative Examples 11 Through 16

Sintered compacts were manufactured in the same manner as in Examples 9 through 11, and the same measurements were performed, except that the container for accommodating the green bodies was made of titanium (Comparative Example 11), molybdenum (Comparative Example 12), or alumina (Comparative Example 13).

In addition, sintered compacts were manufactured in the same manner as in Examples 9 through 11 and the same measurements were performed, except that the container was not used and the green bodies were directly introduced into the sintering furnace and sintered (Comparative Example 14).

The results are shown in the attached Table 6.

It can be seen in Table 6 that despite the fact that the getter is packed in a smaller amount in each of Examples 9 through 11, the resulting sintered compacts are on a par with or better than those obtained in Comparative Examples 11 through 14 in terms of quality; that is, they have high elongation (high strength), low carbon content, low oxygen content, and low porosity. In addition, the sintered compacts obtained in accordance with Examples 9 through 11 have uniform shapes and high dimensional accuracy of each part despite the complex shapes.

Moreover, the graphite containers of Examples 9 through 11 are much easier to machine or manufacture than those in Comparative Examples 11 through 13 and have a considerable service life (effective number of uses), thereby making it possible to achieve a substantial cost reduction.

Furthermore, operability is better in Examples 9 through 11 than in Comparative Examples 11 through 14.

Finally, although this invention has been described in its preferred embodiments and examples with a certain degree of particularity, it is to be understood that the present disclosure of the preferred embodiments can be changed in details and that the combination and variation of components may be changed without departing from the spirit and the scope of this invention as hereinafter claimed.

TABLE 1

| Fe | O | C | N | H | Ti | Mean Grain Diameter |
|---|---|---|---|---|---|---|
| 0.02 wt % | 0.11 wt % | 0.009 wt % | 0.01 wt % | 0.06 wt % | Remainings | 30 $\mu$m |

TABLE 2

| | Material of Green Shape Contact Portion | Times of Polishing | Mean Thickness Reduction [mm] | Inside Diameter [mm] | Diameter Distortion* [mm] | Oxygen Content [wt %] | Porosity [%] |
|---|---|---|---|---|---|---|---|
| Example 1-0 | $ZrO_3$ | New Product | — | 18.05 | 0.05 | 0.315 | 1.9 |
| Example 1-1 | $ZrO_2$ | 1 time | 0.2 | 18.06 | 0.06 | 0 308 | 2.0 |
| Example 1-2 | $ZrO_2$ | 2 times | 0.2 | 18.04 | 0.07 | 0.326 | 2.2 |
| Example 1-3 | $ZrO_2$ | 3 times | 0.3 | 18.06 | 0.08 | 0.331 | 2.3 |
| Example 1-4 | $ZrO_2$ | 4 times | 0.3 | 18.07 | 0.97 | 0.298 | 2.5 |
| Comparative Example 1 | $ZrO_2$ | None | — | 18.80 | 0.56 | 0.881 | 4.5 |
| Example 2-0 | $Y_2O_3$ | New Product | — | 18.05 | 0.04 | 0.297 | 1.8 |
| Example 2-1 | $Y_2O_3$ | 1 time | 0.15 | 18.06 | 0.03 | 0.308 | 2.0 |
| Example 2-2 | $Y_2O_3$ | 2 times | 0.15 | 18.05 | 0.04 | 0.316 | 2.2 |
| Example 2-3 | $Y_2O_3$ | 3 times | 0.2 | 18.04 | 0.06 | 0.398 | 2.3 |
| Comparative Example 2 | $Y_2O_3$ | None | — | 18.95 | 0.85 | 0.871 | 4.3 |

*Diameter Distortion = Maxium Inside Diameter − Minimum Inside Diameter

TABLE 3

| | Material of Green Shape Contact Portion | Times of Polishing | Mean Thickness Reduction [mm] | Inside Diameter [mm] | Diameter Distortion* [mm] | Oxygen Content [wt %] | Porosity [%] |
|---|---|---|---|---|---|---|---|
| Example 3-0 | CaO | New Product | — | 18.04 | 0.05 | 0.298 | 1.6 |
| Example 3-1 | CaO | 1 time | 0.1 | 18.03 | 0.04 | 0.305 | 1.8 |
| Example 3-2 | CaO | 2 times | 0.1 | 18.05 | 0.03 | 0.329 | 1.9 |
| Example 3-3 | CaO | 3 times | 0.15 | 18.06 | 0.04 | 0.319 | 2.1 |
| Comparative Example 3 | CaO | None | — | 19.03 | 0.56 | o.735 | 4.1 |
| Example 4-0 | MgO | New Product | — | 18.65 | 0.24 | 0.502 | 1.9 |
| Example 4-1 | MgO | 1 time | 0.2 | 18.70 | 0.36 | 0.498 | 1.9 |
| Example 4-2 | MgO | 2 times | 0.25 | 18.69 | 0.27 | 0.604 | 2.1 |
| Example 4-3 | MgO | 3 times | 0.3 | 18.90 | 0.38 | 0.553 | 2.2 |
| Comparative Example 4 | MgO | None | — | 19.20 | 0.87 | 0.925 | 5.0 |
| Comparative Example 5 | $Al_2O_3$ | New Product | — | 19.35 | 1.23 | 1.298 | 5.2 |

*Diameter Distortion = Maxium Inside Diameter − Minimum Inside Diameter

TABLE 4

| | Material of Green Shape Contact Portion | Times of Polishing | Mean Thickness Reduction [mm] | Inside Diameter [mm] | Diameter Distortion* [mm] | Oxygen Content [wt %] | Porosity [%] |
|---|---|---|---|---|---|---|---|
| Example 5-0 | $ZrO_2$ | New Product | — | 30.05 | 0.08 | 0.314 | 1.7 |
| Example 5-1 | $ZrO_2$ | 1 time | 0.2 | 30.09 | 0.06 | 0.328 | 1.8 |
| Example 5-2 | $ZrO_2$ | 2 times | 0.25 | 30.10 | 0.07 | 0.294 | 2.0 |
| Example 5-3 | $ZrO_2$ | 3 times | 0.25 | 30.07 | 0.07 | 0.307 | 2.0 |
| Example 5-4 | $ZrO_2$ | 4 times | 0.3 | 30.05 | 0.08 | 0.319 | 2.2 |
| Comparative Example 6 | $ZrO_2$ | None | — | 31.21 | 0.85 | 0.853 | 4.1 |

*Diameter Distortion = Maxium Inside Diameter − Minimum Inside Diameter

TABLE 5

| | Material of Container | Total Weight of Green Shape [g] | Weight of Getter [g] | Elongation of Sintered Compact [%] | Carbon Content [%] | Oxygen Content [%] | Porosity [%] | Easiness of Manufacture | Effective Number of Use of Container |
|---|---|---|---|---|---|---|---|---|---|
| Example 6 | Graphite | 1000 | 50 | 11 | 0.054 | 0.313 | 1.9 | ◎ | more than 50 times |
| Example 7 | Graphite | 1000 | 100 | 12 | 0.044 | 0.355 | 2.2 | ◎ | more than 50 times |
| Example 8 | Graphite | 1000 | 300 | 12 | 0.048 | 0.306 | 2.0 | ◎ | more than 50 times |
| Comparative Example 7 | Ti | 1000 | 500 | 13 | 0.042 | 0.292 | 2.1 | Δ | 1 time |
| Comparative Example 8 | Mo | 1000 | 500 | 12 | 0.048 | 0.304 | 2.2 | Δ | 10 times |
| Comparative Example 9 | $Al_2O_3$ | 100 | 60 | 9 | 0.049 | 0.321 | 2.0 | X | 15 times |
| Comparative Example 10 | No Container | 1000 | — | ≦2 | 0.895 | 1.058 | 4.0 | — | — |

TABLE 6

| | Material of Container | Total Weight of Green Shape [g] | Weight of Getter [g] | Vickers Hardness (Hv) | Carbon Content [%] | Oxygen Content [%] | Porosity [%] | Easiness of Manufacture | Effective Number of Use of Container |
|---|---|---|---|---|---|---|---|---|---|
| Example 9 | Graphite | 10 | 0.5 | 220 | 0.039 | 0.295 | 2.0 | ◎ | more than 50 times |
| Example 10 | Graphite | 10 | 2 | 225 | 0.041 | 0.307 | 2.1 | ◎ | more than 50 times |
| Example 11 | Graphite | 20 | 5 | 231 | 0.037 | 0.296 | 1.8 | ○ | more than 50 times |
| Comparative Example 11 | Ti | 10 | 5 | 218 | 0.032 | 0.276 | 2.0 | Δ | 1 time |
| Comparative Example 12 | Mo | 10 | 6 | 215 | 0.033 | 0.300 | 2.1 | Δ | 8 times |
| Comparative Example 13 | $Al_2O_3$ | 10 | 6 | 223 | 0.040 | 0.321 | 2.2 | X | 5 times |
| Comparative Example 14 | No Container | 5 | — | 425 | 0.925 | 1.135 | 3.6 | — | — |

What is claimed is:

1. A method of manufacturing a sintered compact, in which a sintered compact is manufactured by sintering at least one green body mainly composed titanium or titanium alloy powder, wherein said green body is sintered under the condition that said green body is substantially within a container formed of carbon materials.

2. The method of manufacturing a sintered compact as claimed in claim 1, wherein said container is constructed from a casing having an opening and a lid for closing the opening of said casing, in which when the opening is closed by said lid, said container is kept in a sealed position or in a state that passage of air is considerably restrained.

3. The method of manufacturing a sintered compact as claimed in claim 2, wherein the sintering is carried out under the condition that a getter is disposed in the vicinity of the opening of said container.

4. The method of manufacturing a sintered compact as claimed in claim 3, wherein an amount of the getter to be packed is 5 to 48 w % of the total weight of the green body.

5. The method of manufacturing a sintered compact as claimed in claim 1, wherein a setter having a green body contact portion is provided within said container, and said green body contact portion is formed of an inactive material which does not react with said green body when sintered, in which sintering is carried out under the condition that said green body is placed on said green body contact portion of said setter.

6. The method of manufacturing a sintered compact as claimed in claim 5, wherein said inactive material is mainly composed of oxides of metals whose standard free energy of oxide formation is higher than that of the titanium or titanium alloy of said green body.

7. The method of manufacturing a sintered compact as claimed in claim 6, wherein a base member formed of carbon materials is joined to said green body contact portion.

8. The method of manufacturing a sintered compact as claimed in claim 1, wherein the carbon materials which form said container are one mainly formed of graphite or black lead.

9. The method of manufacturing a sintered compact as claimed in claim 1, wherein a sintering atmosphere for the green body is a vacuum less than $1\times10^{-2}$ Torr or an inert gas atmosphere.

10. The method of manufacturing a sintered compact as claimed in claim 1, wherein said green body is manufactured by a metallic powder injection molding method.

11. A method of manufacturing a sintered compact, in which a sintered compact is manufactured by sintering at least one green body mainly composed titanium or titanium alloy powder, wherein sintering is carried out under the condition that said green body is substantially within a container formed of carbon materials, and then said container is placed within a sintering furnace having walls formed of carbon materials.

12. The method of manufacturing a sintered compact as claimed in claim 11, wherein said sintering is carried out under the condition that a getter in an amount of 5 to 48 w % of the total weight of the green body is put in said container.

* * * * *